United States Patent [19]

Corse

[11] 4,271,760

[45] Jun. 9, 1981

[54] PRINTING MACHINES OF THE OFFSET TYPE

[75] Inventor: Louis G. Corse, Chaumont-sur-Tharonne, France

[73] Assignee: Machines Chambon, Orleans, France

[21] Appl. No.: 58,266

[22] Filed: Jul. 17, 1979

[30] Foreign Application Priority Data

Jul. 27, 1978 [FR] France ..... 78 22240

[51] Int. Cl.[3] ..... B41F 7/04; B41F 31/34

[52] U.S. Cl. ..... 101/142; 101/217; 101/349; 101/352

[58] Field of Search ..... 101/352, 351, 348, 349, 101/357, 358, 361, 362, 341, 342, 345, 346, 148, 247, 206–209, 218, 182, 184, 185, 142, 144, DIG. 10, 217, 177; 308/62

[56] References Cited

U.S. PATENT DOCUMENTS

| | | | |
|---|---|---|---|
| 2,711,935 | 6/1955 | Miles | 308/62 |
| 3,223,028 | 12/1965 | Brigham | 101/349 X |
| 3,323,452 | 6/1967 | Pasquinelli | 101/352 X |
| 3,440,958 | 4/1969 | Benda et al. | 101/349 |
| 3,448,686 | 6/1969 | Bohman | 101/349 |
| 3,538,849 | 11/1970 | Bohman | 101/352 |

*Primary Examiner*—J. Reed Fisher

*Attorney, Agent, or Firm*—McAulay, Fields, Fisher, Goldstein & Nissen

[57] ABSTRACT

An offset printing machine comprises a plate cylinder and a blanket cylinder respectively carrying roller tracks rolling on one another and determining the center distance between the two cylinders. At least one inking roller with a supple peripheral layer, fed with ink from an inking assembly, is carried by levers pivoted about the axis of an inking cylinder and it carries roller tracks in contact with those of the plate cylinder. The shaft of the inking roller is mounted in its roller tracks via eccentric hubs locked on the shaft and pivoting in the roller tracks via bearings, and one end of this shaft is fast with a gear coupled to a control shaft for adjusting the pressure contact of the inking roller upon the plate cylinder.

6 Claims, 6 Drawing Figures

PRINTING MACHINES OF THE OFFSET TYPE

BACKGROUND OF THE INVENTION

The present invention relates to improvements in printing machines of the offset type.

Offset printing machines generally comprise a blanket cylinder and a counter cylinder between which a web which is to be printed passes, a plate cylinder tangential to the blanket cylinder, an inking unit and a moistening device ensuring a distribution of a film of ink and a film of moistening liquid on the periphery of the plate cylinder. The inking unit comprises an inking roller having a peripheral coating made of supple material (rubber), this inking roller receiving ink from an inking assembly, via ink vibrator rollers and inking cylinders, and depositing this ink on the plate cylinder. The inking roller is applied to the plate cylinder under a more or less high pressure, producing a more or less considerable crushing of the supple peripheral coating. This crushing is generally constant and the length of the crushing arc may vary for example between 3 and 5 mm. If this crushing is too great, a barrier is created against the moistening liquid as well as trails on the impression, whilst, if the crushing is not great enough, the quantity of ink transmitted to the plate cylinder is not sufficient.

The plate cylinder carries roller tracks which are in contact with corresponding roller tracks fast with the blanket cylinder, with a view to ensuring a constant centre distance between these two cylinders. To ensure a constant pressure contact (crushing of the supple coating of the inking roller) between the inking roller and the plate cylinder, it may also be provided to place roller tracks on the inking roller, these roller tracks abutting on those of the plate cylinder. However, this solution presents a drawback in that, as the printing machine functions, the inking roller wears out, this requiring an adjustment of this inking roller and consequently a reduction of its diameter. Consequently, the roller tracks must be changed, the initial roller tracks having to be replaced by a roller track of smaller diameter.

Furthermore, in known offset printing machines, it is necessary, when the format is changed, to proceed, before a new series of impression in the new format is started, with a preliminary operation consisting in a fresh adjustment of the pressure contact of the inking roller on the plate cylinder in order to obtain a good quality impression. This preliminary operation naturally involves an appreciable loss of time.

SUMMARY OF THE INVENTION

It is an object of the present invention to remedy these drawbacks by providing an offset printing machine comprising a mechanism enabling the pressure contact, i.e. the distance of the inking roller with respect to the plate cylinder, to be very simply adjusted.

To this end, this offset printing machine comprising a plate cylinder and a blanket cylinder respectively carrying roller tracks, rolling on one another and determining the centre distance between the two cylinders, at least one inking roller with a supple peripheral layer, fed with ink from an inking assembly, via ink vibrator cylinders and an inking cylinder, said inking roller being carried by levers pivoted about the axis of the inking cylinder and carrying roller tracks in contact with those of the plate cylinder, for controlling the pressure contact between the inking roller and the plate cylinder, i.e. the crushing of the supple peripheral layer of the inking roller, is characterized in that the shaft of the inking roller is mounted in its roller tracks via eccentric hubs locked on the shaft and pivoting in the roller tracks via bearings, and one end of this shaft is fast with a gear coupled to a control shaft for adjusting the pressure contact of the inking roller. The invention therefore offers the advantage that, in case of wear of the inking roller, it is no longer necessary to replace the roller tracks by others of smaller diameter, as it suffices to modify the position of the axis of the inking roller with respect to the axis of the roller tracks, by causing the shaft of this roller to rotate on itself and the eccentric hubs ensuring the connection with the roller tracks.

The mechanism according to the invention makes it possible, in case of a shift of the inking, i.e. of the inking roller, to return, upon the new fixing under pressure, to the initial touch, i.e. to obtain the same crushing of the inking roller on the plate cylinder again.

The same applies to the case of a change in format, i.e. a change in diameter of the plate cylinder: in fact, the mechanism according to the invention makes it possible automatically to maintain, with the new format, the previously adjusted pressure contact upon contact with the plate cylinder used beforehand.

BRIEF DESCRIPTION OF THE DRAWINGS

The invention will be more readily understood on reading the following description with reference to the accompanying drawings, in which.

DESCRIPTION OF THE PREFERRED EMBODIMENT

Figure 1:
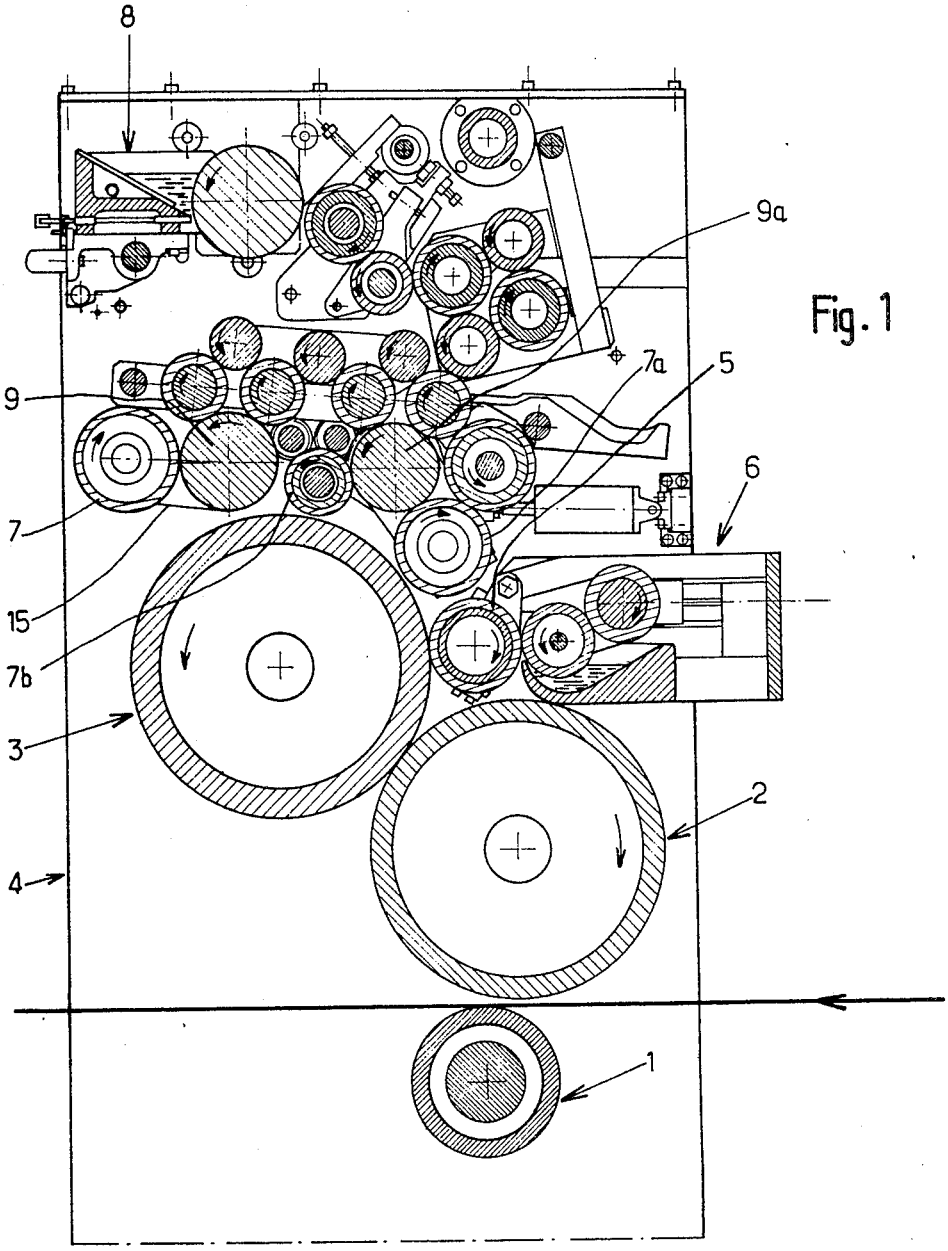
FIG. 1 is a view in vertical and longitudinal section (considered with respect to the web having to be printed) of an offset printing machine according to the invention.

Referring now to the drawings, the offset printing machine to which the present invention relates conventionally comprises a lower counter cylinder 1, a blanket cylinder 2, a plate cylinder 3, all these cylinders being mounted to rotate about horizontal spindles carried by a frame 4. The web of paper which is to be printed passes between the lower counter-cylinder 1 and the blanket cylinder 2 which is tangential to the plate cylinder 3. With this latter cooperate a moistening cylinder 5 forming part of a moistening device 6 and inking rollers 7, *7a*, *7b* supplied with ink from an inking assembly 8, located in the upper part of the frame 4, via a certain number of ink vibrator cylinders.

The inking rollers 7, *7a*, *7b* of which the preriphery is made of supple material (rubber) are respectively tangential to inking cylinders 9, 9*a* constituted by rollers driven in rotation and on the periphery of which the ink is conducted from the upper ink assembly 8, by the distributor and ink vibrator cylinders.

As the mechanism according to the invention is the same for each of the inking rollers 7, 7*a*, 7*b*, only one of them will be described in detail, namely the one associated with the left-hand inking roller 7.

Figure 2:
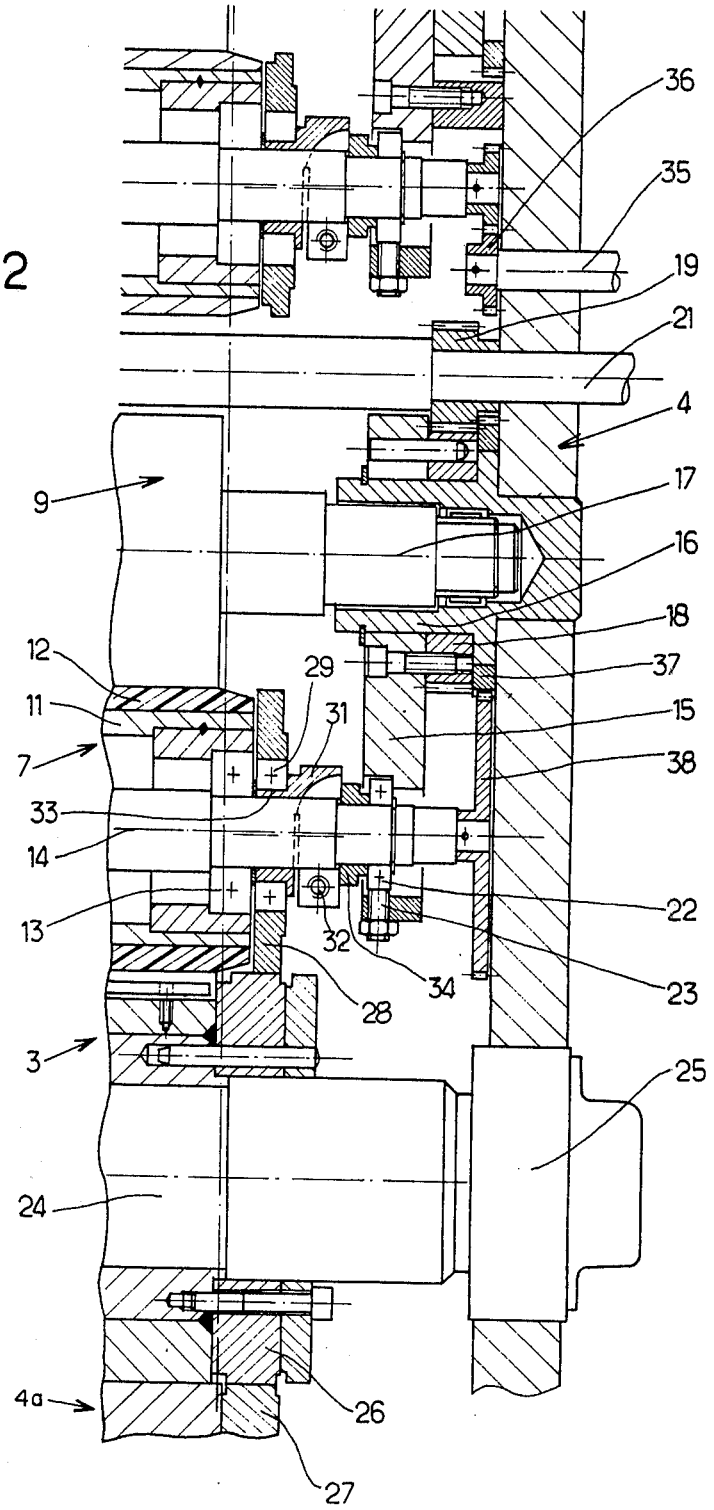
FIG. 2 is a view in transverse section of the mechanism enabling the pressure contact of the inking roller on the plate cylinder to be adjusted.

The inking roller comprises, as may be more readily seen in FIG. 2, a metal cylindrical support 11 on which is mounted a coating 12 made of rubber, this support being mounted to rotate, via bearings 13, on a horizontal and transverse shaft 14. This shaft 14 is carried, as its two ends, by two levers 15 which are pivoted about the axis of rotation of the inking cylinder 9 with which the inking roller 7 is in contact. FIG. 2 shows that each lever 15 pivots on the outer cylindrical surface of a bearing 16 carried by the frame 4 and inside which is housed the end of the shaft 17 of the inking cylinder 9. The part of the lever 15 forming hub, i.e. surrounding the bearing 16, is fast with a coaxial pinion 18, itself meshing with another pinion 19 fast with a transverse control shaft 21 mounted to rotate on the frame. A rotation of this control shaft 21 consequently brings about a pivoting of the levers 15 about the axis of the inking cylinder 9 and a correlative movement of the inking roller 7 in the direction of the plate cylinder 3 or in the opposite direction, so as to enable the format to be changed.

The shaft 14 of the inking roller 7 is carried, in levers 15, by bearings 22 disposed in housings provided in these levers 15 and of which the position may be adjusted by means of screws 23. These screws which abut on the outer cages of the bearings 22, enable these bearings to be shifted more or less in the direction of the axis of pivoting of the levers 15, i.e. of the inking cylinder 9. They therefore make it possible to regulate the support of the roller 7 on the inking cylinder 9, in other words the crushing of the supple layer 12 in contact with the inking cylinder 9 and the contact pressure at this spot.

As was seen previously, in position of fixing under pressure, the inking roller is also tangential to the plate cylinder 3 and it is applied thereon under a more or less high pressure, creating a more or less considerable crushing of the supple peripheral layer 12. This crushing arc is generally constant and its length may vary, according to the case, between 3 and 5 mm. The plate cylinder 3 which is fast with a transverse and horizontal shaft 24 mounted to rotate in bearings 25 fixed to the frame 4, itself carries roller tracks 26 which are constituted by rings fixed to the front faces of the plate cylinder 3. These roller tracks 26 bear in turn on similar roller tracks 27 fast with the blanket cylinder 4*a*, so as to ensure a constant centre distance between the plate cylinder 3 and the blanket cylinder 4*a*.

To assure a constant pressure contact between the inking roller 7 and the plate cylinder 3, the inking roller 7 also carries roller tracks 28 which roll on the roller tracks 26 of the plate cylinder 3.

As may be seen in FIG. 2, each roller track 28 is mounted, via a roller 29, on an eccentric hub 31 fixed on the shaft 14 of the inking roller 7. Each hub 31 is split and is blocked on the shaft 14 by means of a clamping screw 32. The angular position of each of the two hubs 31 about the axis of the inking roller 7 may thus be individually adjusted, in order to allow a possible alignment, between the front and the rear, of the eccentric hubs 31, therefore of the roller tracks 28. Each of the hubs 31 presents a cylindrical bearing surface 33 which is eccentric with respect to the axis of the shaft 14 and on which is blocked the bearing 29 supporting the roller track 28. Each eccentric hub 31 is immobilised between on the one hand the roller 13 of the inking roller 7, in abutment against a shoulder of the shaft 14, and on the other hand an annular crosspiece 34 disposed between the hub 31 and the bearing 22 carried by the lever 15.

From the foregoing description, it is therefore seen that the support, i.e. the pressure contact of the inking roller 7 on the plate cylinder 3, is given by the rotation of the two levers 15 about the axis of the inking cylinder 9, whilst a rotation of the shaft 14, due to the presence of the two eccentric hubs 31, causes the roller tracks 28 to move towards or away from those 26 of the plate cylinder 3, therefore brings about a variation of the pressure between the inking roller 7 and the plate cylinder 3.

The rotation of the shaft 14 of the inking roller 7 is controlled from a horizontal and transerse shaft 35 mounted to rotate in the front part of the frame 4 of the printing machine. This control shaft is fast with a pinion 36 which in turn drives a gear 37 mounted to rotate on the bearing 16 of the shaft of the inking cylinder 9. This gear is in turn in mesh with another gear 38 which is fast with the front end of the shaft 14 of the inking roller 7.

It is thus seen that a rotation of the control shaft 35 brings about a rotation of the gear 38 and consequently of the shaft 14 and of the two hubs 31 that it carries, hence a variation in the centre distance between the inking roller 7 and the plate cylinder 3.

The shaft 35 for controlling the adjustment of the pressure contact is fast, at its outer front end, with a hub 39 carrying a disc 41 graduated in format dimensions and a disc 40 for blocking the shaft 35 in rotation. A second disc 42 is also mounted to rotate on the hub 39, which disc carries a mark 43 on its periphery. This disc is freely movable in rotation about the axis of the shaft 35 and it may be immobilised in any suitable position, by being blocked on a vertical cheek member 44 fast with the frame of the machine, by means of a locking device 45, by two screws 45*a*. This locking device comprises a handle 46 whose rotation provokes the actuation of a clamp 47 ensuring the blocking of the disc 40 fast with the hub 39. The stopping of the shaft 35 in rotation is thus ensured.

At its front end, the shaft 35 for controlling the adjustment of the pressure contact is fast with a manoeuvring wheel 48.

Figure 6:
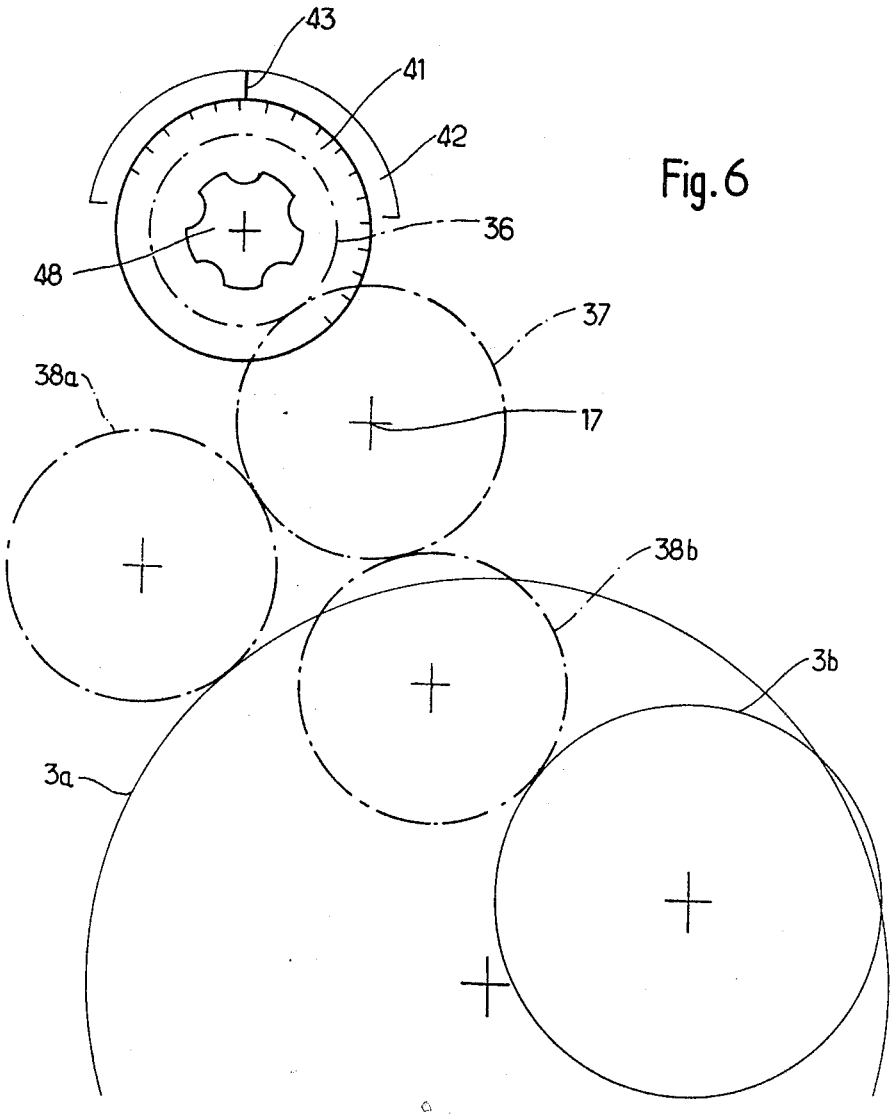
FIG. 6 is a schematic view of the mechanism controlling the rotation of the shaft of the inking roller on itself, with a view to adjusting the pressure contact.

The purpose of the disc 42 carrying the mark 43 is to make it possible, upon a change of format, to return the eccentric hubs 31 determining the position of the roller tracks 28 of the inking roller 7 into position, in order to obtain the same pressure contact as for the preceding format. In fact, when the format is changed, the plate cylinder 3 changes diameter. FIG. 6 shows for example two plate cylinders of different diameters, namely a plate cylinder 3*a* of large diameter and a plate cylinder 3*b* of small diameter, as well as the corresponding positions in space of the gear 38, i.e. of the inking roller, namely the position 38*a* in the case of the cylinder 3*a* of large diameter and position 38*b* in the case of the small diameter cylinder 3*b*. In the two end positions 38*a*, 38*b*, the gear 38 is always in mesh with the intermediate gear 37.

It is therefore seen that, when the axis of the inking roller 7 rotates about the axis 17 of the inking cylinder, i.e. the intermediate gear 37, this brings about a rotation of the gear 38 on itself and consequently a shift of the eccentricity of the roller tracks 28.

The graduation of the disc 41 into formats is calculated as a function of the taking up of these rotations.

The order of the operations, for adjusting the printing machine according to the invention, is therefore as follows;

1. The support of the inking roller 7 on the inking cylinder 9 is firstly adjusted by means of screws 23.

2. With the aid of the maneuvering wheel 48 fast with the shaft 35, said latter and consequently the shaft 14 is rotated, so as experimentally to adjust the pressure contact of the inking roller 7 on the plate cylinder 3 for any format M.

Figure 4:
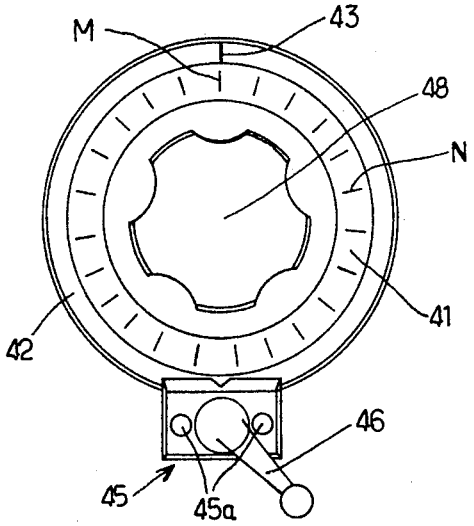
FIG. 4 is a view in elevation of the knob fast with the shaft for controlling the adjustment of the pressure contact and of the graduated disc associated therewith.
Figure 5:
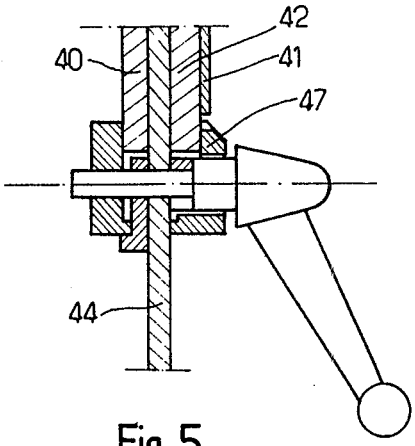
FIG. 5 is a view in part vertical section, on a larger scale, of the device of FIG. 4.
Figure 3:
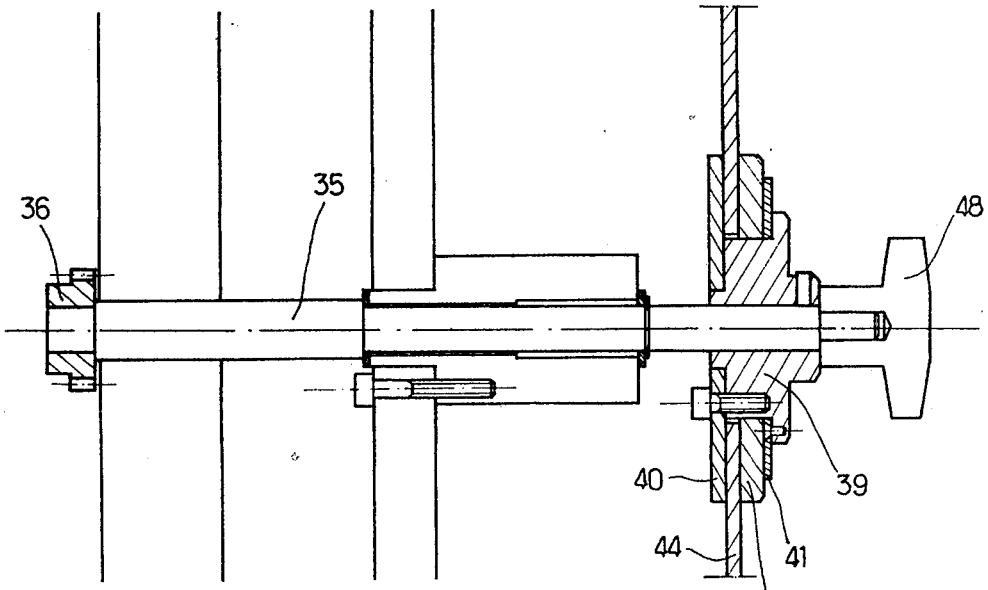
FIG. 3 is a view in part horizontal and transverse section through the axis of the shaft controlling the adjustment of the pressure contact of the inking roller.

3. Once the pressure contact has been adjusted in this way so as to obtain a good quality impression, the disc 42 is rotated freely on the hub 39, after having unblocked the locking device 45. Its mark 43 is brought opposite the graduation corresponding to format M (FIG. 4). Once this marking is effected, the disc is again blocked in position by means of the locking device 45.

4. When the format is changed (for example to pass to format N), the shaft 35 is rotated by means of its maneuvering wheel 48, after having unblocked the disc 40 by the handle 46, so as to bring the graduated disc 41 which is fast therewith into position such that the graduation corresponding to the new format N is opposite the mark 43 on the disc 42. The rotation of the shaft 35 which corresponds to the angle between the graduations M and N, brings about a correlative rotation of the gear 38 and the shaft 14 which compensates the shift of the eccentricity and enables the same pressure contact to be automatically obtained for the new format as in the case of the former format.

From the foregoing, it is therefore seen that the operation of the offset printing machine according to the invention is considerably simplified.

What is claimed is:

1. An offset printing machine comprising a plate cylinder and a blanket cylinder respectively carrying roller tracks rolling on one another and determining the center distance between the two cylinders, at least one inking roller with a supple peripheral layer, fed with ink from an inking assembly, via ink vibrator cylinders and an inking cylinder, said inking roller being carried by levers pivoted about the axis of the inking cylinder and carrying roller tracks in contact with those of the plate cylinder for controlling the pressure contact between the inking roller and the plate cylinder, and the crushing of the supple peripheral layer of the inking roller, wherein the shaft of the inking roller is mounted in its roller tracks via eccentric hubs locked on the shaft and pivoting in the roller tracks via bearings, and one end of this shaft is fast with a gear coupled to a control shaft for adjusting the pressure contact of the inking roller upon the plate cylinder.

2. An offset printing machine as claimed in claim 1, wherein each eccentric hub is adjustable angularly about the axis of the inking roller and may be blocked in position by means of a screw.

3. An offset printing machine as claimed in claim 1, wherein the gear fast with the shaft of the inking roller is in mesh with an intermediate gear mounted to rotate about the axis of the inking cylinder with which the inking cylinder is in contact, this intermediate gear itself being coupled to a pinion fast with the control shaft to adjust the pressure contact.

4. An offset printing machine as claimed in claim 3, wherein the intermediate gear is mounted to rotate on a bearing of a shaft of the inking cylinder.

5. An offset printing machine as claimed in claim 1, wherein the control shaft for adjusting the pressure contact of the inking roller is fast with a maneuvering wheel and with a first disc bearing graduations corresponding to the different formats, and a second disc, mounted to rotate freely and coaxially with respect to the first disc, bears a mobile mark, this second disc being able to be immobilized in position by means of a locking device.

6. An offset printing machine as claimed in claim 5, wherein the control shaft for adjusting the pressure contact is fast with a hub on which is fixed the first disc bearing the graduations of the formats and may freely rotate the second coaxial disc bearing the mobile mark.

* * * * *